US008789692B2

(12) United States Patent
Chang et al.

(10) Patent No.: US 8,789,692 B2
(45) Date of Patent: Jul. 29, 2014

(54) DESICCATING CONTAINER

(75) Inventors: Yi Ming Chang, Taichung County (TW); Cheng Teng Hsu, Taichung (TW)

(73) Assignee: BIONIME Corporation (TW)

( * ) Notice: Subject to any disclaimer, the term of this patent is extended or adjusted under 35 U.S.C. 154(b) by 195 days.

(21) Appl. No.: 12/793,769

(22) Filed: Jun. 4, 2010

(65) Prior Publication Data

US 2011/0127176 A1 Jun. 2, 2011

(30) Foreign Application Priority Data

Dec. 1, 2009 (TW) ..... 98141075 A

(51) Int. Cl.
*B65D 81/26* (2006.01)
*F17C 11/00* (2006.01)

(52) U.S. Cl.
USPC ..... 206/204; 206/449; 220/849

(58) Field of Classification Search
USPC ..... 206/204, 538, 539, 206, 449; 222/190; 220/849
See application file for complete search history.

(56) References Cited

U.S. PATENT DOCUMENTS

| | | | | | |
|---|---|---|---|---|---|
| 871,803 | A | * | 11/1907 | Kendall | 222/190 |
| 1,252,872 | A | * | 1/1918 | Yoggerst | 222/190 |
| 2,320,309 | A | * | 5/1943 | Smith | 15/104.33 |
| 2,596,763 | A | * | 5/1952 | Crowley | 222/23 |
| 3,135,566 | A | * | 6/1964 | Frank | 206/0.82 |
| 3,820,309 | A | * | 6/1974 | Cullen et al. | 206/0.5 |
| 5,114,003 | A | * | 5/1992 | Jackisch et al. | 206/204 |
| 5,911,937 | A | | 6/1999 | Hekal | |
| 5,934,773 | A | * | 8/1999 | Ferrell | 206/204 |
| 2010/0140116 | A1 | * | 6/2010 | Stiene et al. | 206/204 |

FOREIGN PATENT DOCUMENTS

| | | |
|---|---|---|
| TW | M363913 | 9/2009 |

* cited by examiner

*Primary Examiner* — Mickey Yu
*Assistant Examiner* — Chun Cheung
(74) *Attorney, Agent, or Firm* — Volpe and Koenig, P.C.

(57) ABSTRACT

A desiccating container is provided in the present invention. The desiccating container including an outer can; and an inner can configured in the outer can and having a wall with a containing space and a desiccant is contained in the containing space.

14 Claims, 5 Drawing Sheets

DESICCATING CONTAINER

FIELD OF THE INVENTION

The invention is related to a container, and more particularly to a desiccating or a moisture-absorbing container.

BACKGROUND OF THE INVENTION

In order to preserve a glucose strip, a reagent or a drug for a long period, these items are usually reserved in an air-sealed can for preventing being moistened and for ensuing quality thereof. There are currently various kinds of air-sealed devices over the market, including the mentioned air-sealed based devices, a vacuum based devices or an air-sealed devices with desiccant function.

However, with respect to the structure for a conventional air-sealed can, a barrier point or a barrier ring is usually disposed on body portion of the conventional air-sealed can, from which defects are accordingly derived. The derived defects are a consequence resulted from an ill design on structure or a non-circle product having a body biased from circle. As to the ill design on structure, it results in discrepancy for the force between respective barrier points or barrier ring with respect to the sealing ring on the cap. While the stress resulted from the force is changed, the cap will protrude from the side accepting minor force or even burst. As to the barrier ring, though it overcomes the defects existing in the use of barrier points to avoid the protrusion or burst by contacting with the cap in line-contacting instead of point-contacting, it also encounters troubles while the pressure or temperature in the environmental is significantly varied, since the air existing in the air-sealed can will proportionally expand its volume with respect to ascension of the temperature, which finally results in a burst, once the tolerance limitation ceiling is reached.

Furthermore, there are many reasons to cause a non-circle product, including the bad precision during machining, the ill plastic injection mold, the collision during cargo delivering and the shrinkage due to temperature variation. Since the friction force along the contacting line between the barrier ring and the cap is different for a non-circle product, while the pressure in the environmental is changed from high to low, a portion of the cap accepting a minor friction will consequently slide therefrom and finally protrude. Thus, the barrier ring can not tightly resist to the cap, so that the can not be sealed accordingly.

Hence, in order to improve the aforementioned air-sealed can, many kinds of air-sealed cans are developed. For instance, a desiccating can having a desiccant deposited into the air-sealed can to absorb the moisture certainly invading into the can is developed. Please refer to FIG. 1, which is a representative diagram for Taiwan Patent No. M363913. The body 10 disclosed in FIG. 1 includes a tank 14 that has a drug containing chamber 12 existing in the central portion and a plurality of containing chamber 11 annularly disposed along the drug containing chamber 12. The drug containing chamber 12 and the plurality of containing chamber 11 has bottom where an opening 121 and a vent 111 are respectively disposed. The opening 121 and the vent 111 are communicable to each other. A desiccant could be deposited into the drug containing chamber 12 for absorbing the moisture existing in the plurality of containing chamber 11 communicable to the drug containing chamber 12, so as to benefit the preservation of a glucose strip, a reagent or a drug reserved in the plurality of containing chamber 11.

Please resumes referring to FIG. 2(*a*), which is a diagram for U.S. Pat. No. 5,911,937. The container 61 in FIG. 2(*a*) has a desiccant entrained plastic layer 20 disposed on an inner surface 65. The desiccant entrained plastic layer 20 is formed by entraining a desiccating agent 30 and a channeling agent 35 into a polymer 25. The channeling agent 35 is utilized for forming a passage (not shown in FIG. 2(*a*)) in the polymer 25 which passage renders the desiccating agent 30 communicable to room in the container 61, whereby the desiccating agent 30 entrained into the polymer 25 can absorb the moisture existing in the container 61. The desiccating agent 30 could also be directly entrained into the inner surface 65 of the container 61 to be a part of the inner surface 65, as shown in FIG. 2(*b*).

Although currently there are many kinds of desiccating can are developed for absorbing the moisture existing in the sealed or non-sealed can and the drawbacks existing in the conventional air-sealed can are more or less improved thereby, there are plenty of room left behind for the structure of these air-sealed to be improved. Therefore, in view of the drawbacks in the prior art, a desiccating can is thus provided. The particular design in the present invention not only solves the problems described above, but also is easy to be implemented. Thus, the invention has the utility for the industry.

SUMMARY OF THE INVENTION

Thus the present invention aims to improve the aforementioned defects, to design a novel structure for a can and to provide a novel desiccating container that is capable to effectively overcome the aforementioned defects and further has an air-sealed effect.

The desiccating container provided by the present invention has an annular ring, cooperated with the sealing boundary, disposed along the edge near the opening of the body for preventing the burst or protrusion of the cap. With use of an adequate desiccant, a desiccating container with air-sealed capability is accordingly provided.

In accordance with the first aspect of the present invention, a desiccating container is provided. The desiccating container including an outer can; and an inner can configured in the outer can and having a wall with a containing space where a desiccant is contained in the containing space.

Preferably, the desiccating container further includes a cap disposed on the outer can to close the outer can.

Preferably, the cap further has an edge and a protrusion protruded from the edge.

Preferably, the cap further has a sealing boundary disposed around the edge, in which boundary a wall of the outer can is embeddable.

Preferably, the outer can has a hollow cylinder shape with an opening at one end thereof.

Preferably, the outer can further has an annular ring disposed along the opening.

Preferably, the inner can further has a plurality of containing spaces and all the containing spaces are disposed symmetrically around the wall.

Preferably, the inner can further has a bottom with a buckle fixing the inner can to a position relative to the outer can.

Preferably, the containing space further has an opening through which the desiccant is deposited into the containing space.

Preferably, the containing space further has an aperture, through which moisture in the outer can is communicable to the desiccant in the containing space.

Preferably, the containing space is disposed at a bottom of the inner can.

Preferably, the containing space is disposed into a side wall of the inner can.

Preferably, the containing space is disposed at an inner side of the wall.

Preferably, the containing space is disposed at an outer side of the wall.

Preferably, a height of the inner can is smaller than that of the outer can.

Preferably, a diameter of the inner can is smaller than that of the outer can.

Preferably, the desiccant has a capability to indicate an effect of moisture absorption thereof.

In accordance with the second aspect of the present invention, a moisture-absorbing container is provided. The moisture-absorbing container comprising a body; and an insert fixed to the body and having a side wall with a chamber for containing the desiccant.

Preferably, the body further has a cap for closing the body.

In accordance with the third aspect of the present invention, a moisture absorbing container is provided. The moisture absorbing container comprising a body having a side wall with a vacancy for containing the desiccant.

Other objects, advantages and efficacy of the present invention will be described in detail below taken from the preferred embodiments with reference to the accompanying drawings, in which:

BRIEF DESCRIPTION OF THE DRAWINGS

FIG. 5(*b*) is a diagram illustrating the insert from a second viewing angle according to the present invention.

DETAILED DESCRIPTION OF THE PREFERRED EMBODIMENT

Figure 1:
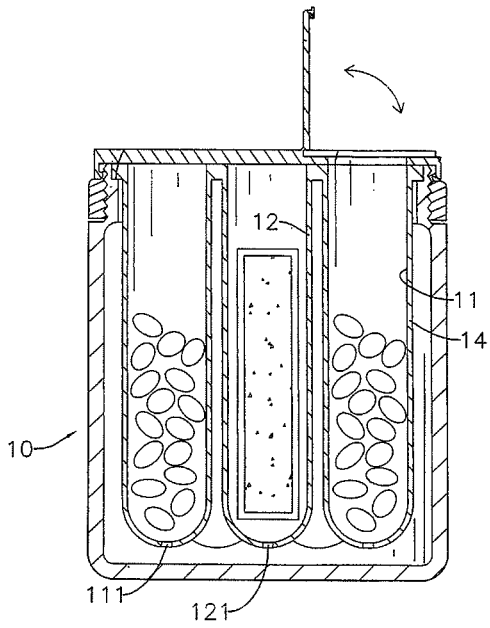
Fig. 1 (Prior Art)
FIG. 1 is a representative diagram for illustrating Taiwan Patent No. M363913.
Figure 2A:
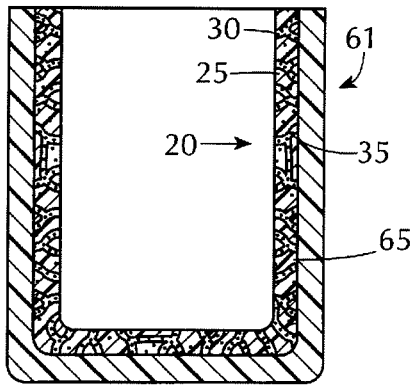
Fig. 2(a) (Prior Art)
FIGS. 2(*a*) and 2(*b*) are diagrams for illustrating U.S. Pat. No. 5,911,937.
Figure 2B:
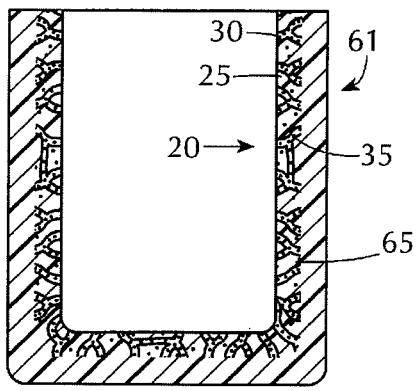
Fig. 2(b) (Prior Art)

The present invention will now be described more specifically to the following embodiments. However, it is to be noted that the following descriptions of preferred embodiments of this invention are presented herein for the purposes of illustration and description only; it is not intended to be exhaustive or to be limited to the precise form disclosed.

Moreover, in order to provide clearer descriptions to facilitate easily understanding of the present invention, the parts of the drawing do not draw in accordance with their relative sizes. Some sizes and scales have been exaggerated. The parts of unrelated details are not drawn completely to simplify the drawing.

Figure 3:
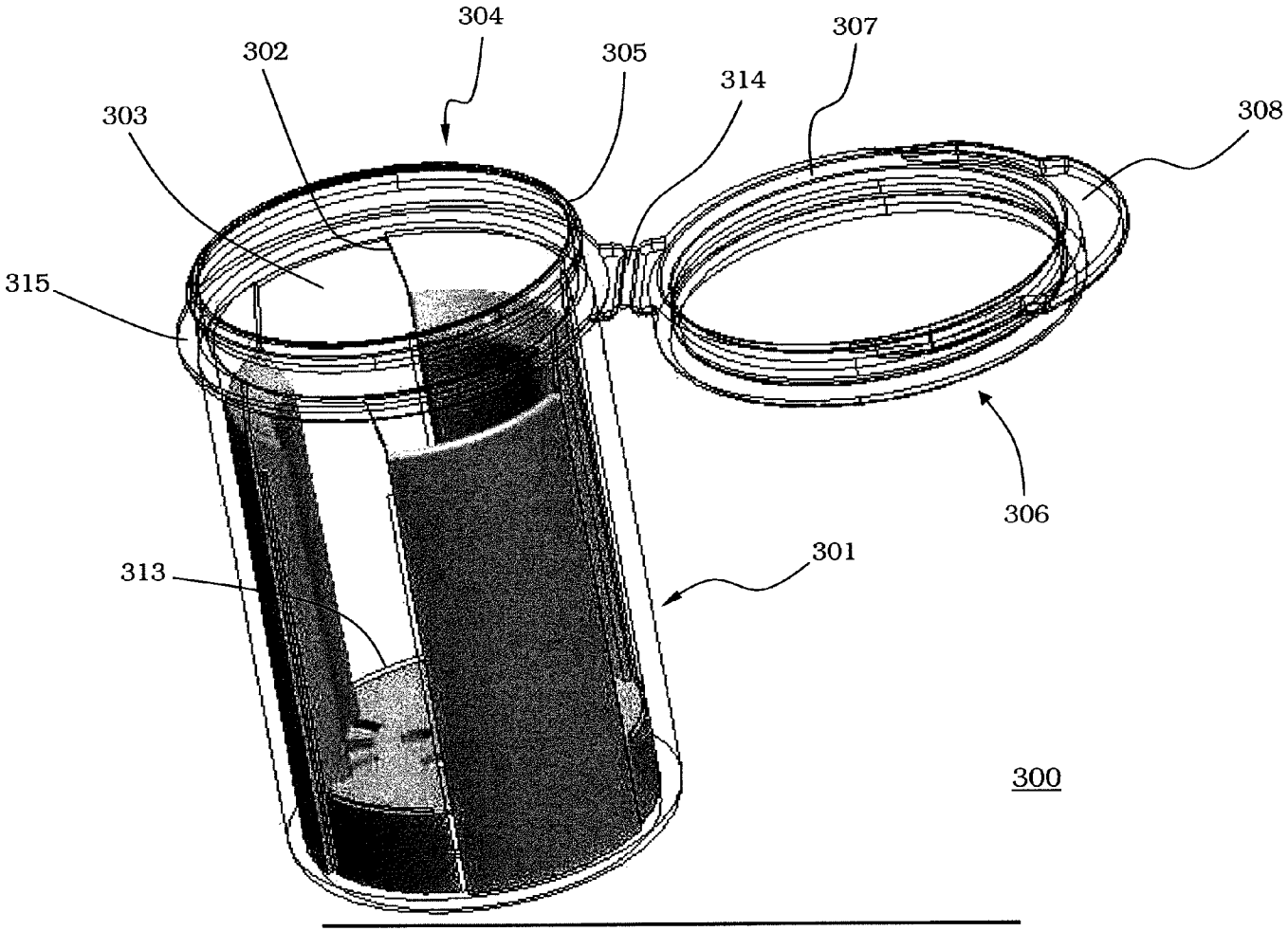
FIG. 3 is a diagram illustrating a first embodiment of the desiccating container according to the present invention.
Figure 4:
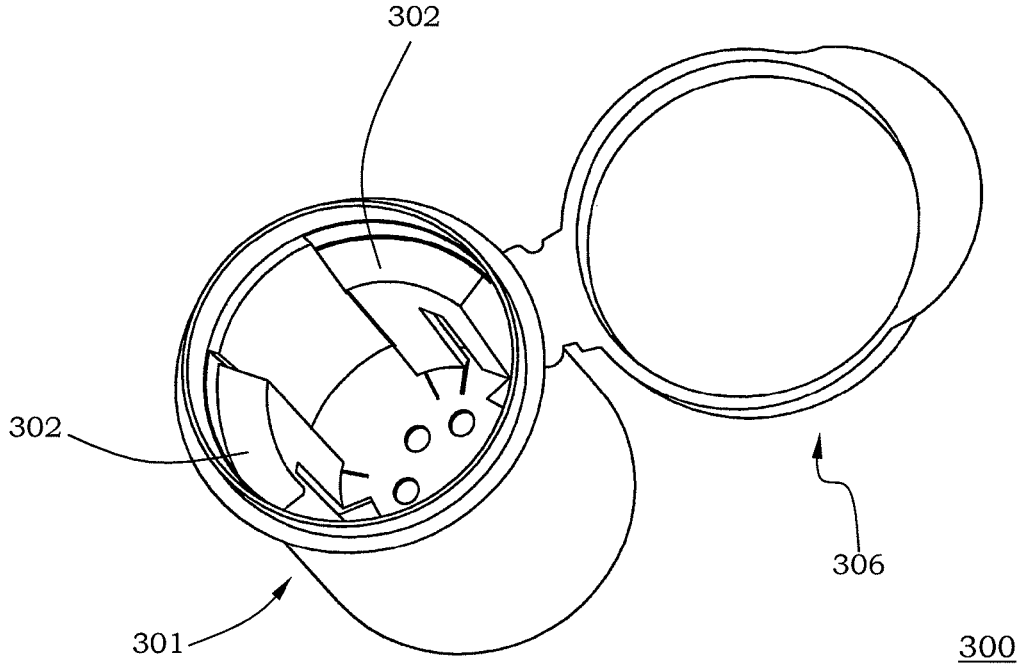
FIG. 4 is a diagram illustrating the assembled body and insert according to the present invention.

Please refer to FIG. 3, which is a diagram illustrating the desiccating container according to the present invention. The desiccating container 300 includes a body 301 (termed as outer can or outer bottle equivalently) and an insert (termed as inner can or inner bottle equivalently) and the insert 302 is fixed/installed into the body 301. The inner space 303 in the desiccating container 300 is preferably utilized for reserving a glucose strip, a reagent or a drug. A height of the insert 302 is preferably smaller than that of the body 301 and a diameter of the insert 302 is preferably smaller than that of the body 301. The insert 302 further has a bottom with a buckle 313 for fixing the insert 302 to a position relative to the body 301 and for preventing the insert 302 sliding out of the body 301 or being easily took out from the body 301. The assembled body 301 and insert 302 are shown in FIG. 4.

The body 301 preferably has a hollow cylinder shape with an opening 304 at the top of the cylinder. The body 301 further has a blocking ring 315 disposed along a wall near the opening 304. That is the blocking ring 315 is disposed along an edge of the opening 304 to act as a barrier ring. The blocking ring 315 is preferably made by an electric discharge machine (EDM) scheme or manufactured by a CNC lathe.

The body 301 further has a cap 306 for closing the body 301. The cap 306 is formed around the opening 304 of the body 301 by an integral moulding scheme to be an integral of the body 301. The cap 306 can also be a separate part of the body 301 connected to the opening 304 of body 301 by a conventional connecting component 314. The cap 306 further has a sealing boundary 307 circularly disposed along the edge of the cap 306 acting as a sealing ring, in which boundary a wall of the body 301 is embeddable. The diameter of the sealing boundary 307 is slightly smaller than that of the annular ring 305. While the cap 306 is closed to the opening 304 of the body 301, the sealing boundary 307 is tightly resisted to the annular ring 305 and the annular ring 305 is just embedded into the sealing boundary 307, so that the body 301 is embedded to the cap 306 with achieving air-sealed. The cap 306 further has a protrusion 308 protruded from the edge of the cap 306. A user can easily open the cap 306 that is tightly closed with the body 301 by using the protrusion 308.

Figure 5A:
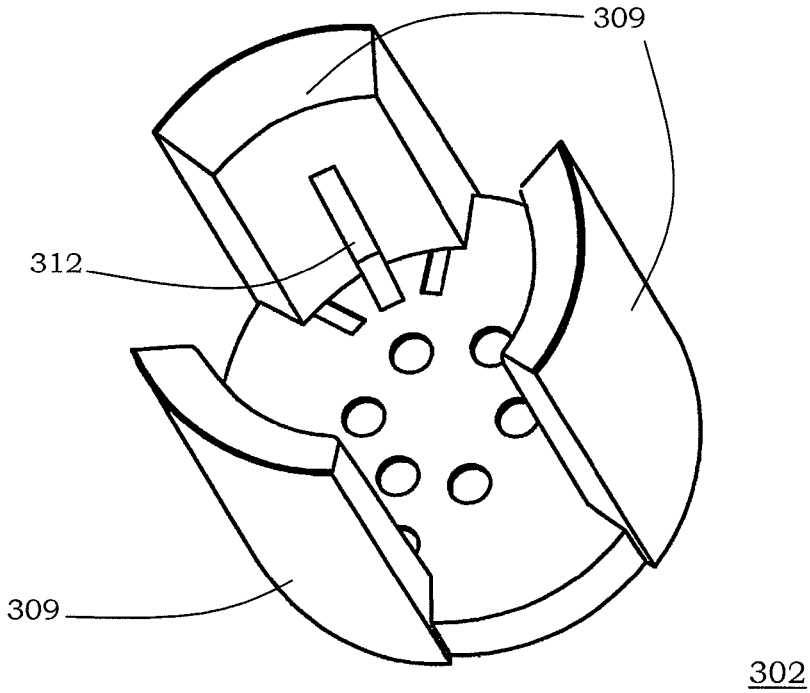
FIG. 5(*a*) is a diagram illustrating the insert from a first viewing angle according to the present invention.
Figure 5B:
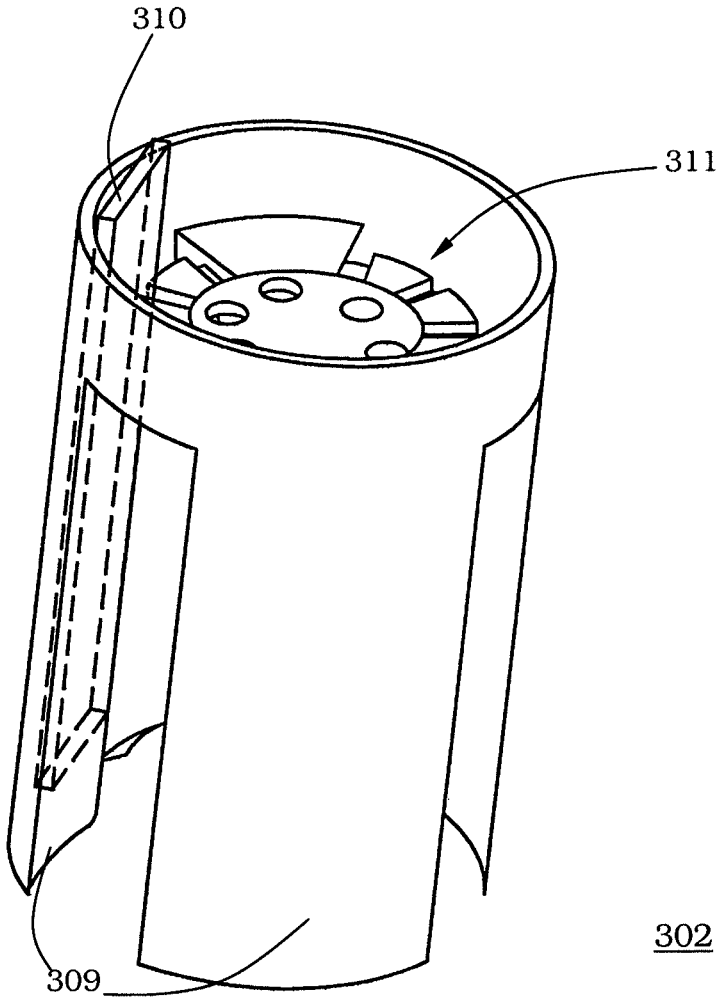

Please referring to FIGS. 5(*a*) and 5(*b*) at the same time. FIG. 5(*a*) is a diagram illustrating the insert from a first viewing angle according to the present invention and FIG. 5(*b*) is a diagram illustrating the insert from a second viewing angle according to the present invention. The insert 302 disclosed in FIGS. 5(*a*) and 5(*b*) preferably has a plurality of containing spaces (termed as chamber or vacancy equivalently) 309 and all the containing spaces 309 are disposed symmetrically around the wall. The plurality of containing spaces 309 is utilized as the space for depositing the desiccant 310. All the containing spaces 309 are preferably disposed symmetrically in a tri-direction. Each of the containing spaces 309 further have an opening 311 at one end through which the desiccant 310 is deposited into the containing space 309. The all the containing spaces 309 further have an aperture 312 with preferably an elongated shape, through which moisture in the body 301 is communicable to the desiccant 310 in the containing space 309, so that the desiccant 310 deposited in all the containing spaces 309 could absorb the moisture existing in the inner space 303. Furthermore, the containing space 309 is optionally disposed at a bottom of the insert 302, into a side wall of the insert 302, at an inner side of the side wall of the insert 302 or at an outer side of the side wall of the insert 302. The desiccant 310 deposited in the containing space 309 is preferably selected from a desiccant which has a capability to indicate an effect of moisture absorption thereof or a desiccant which has great capability to absorb moisture, so as to achieve a rapid drying function.

To sum up, while the cap 306 is actually closed on the body 301, a great air-sealed effect is accordingly provided by the interaction that occurs between annular ring 305 and the sealing boundary 307. With the use of desiccant 301 deposited in the containing spaces 309, the desiccating container 300 could provide an effective air-sealed capability, a short drying period and a long-duration drying capability for preserving objects in the desiccating container 300. Furthermore, since the annular ring 305 near the opening 304 is in a circular shape, it could effectively prevent the cap 306 separating from the body 301.

Figure 6:
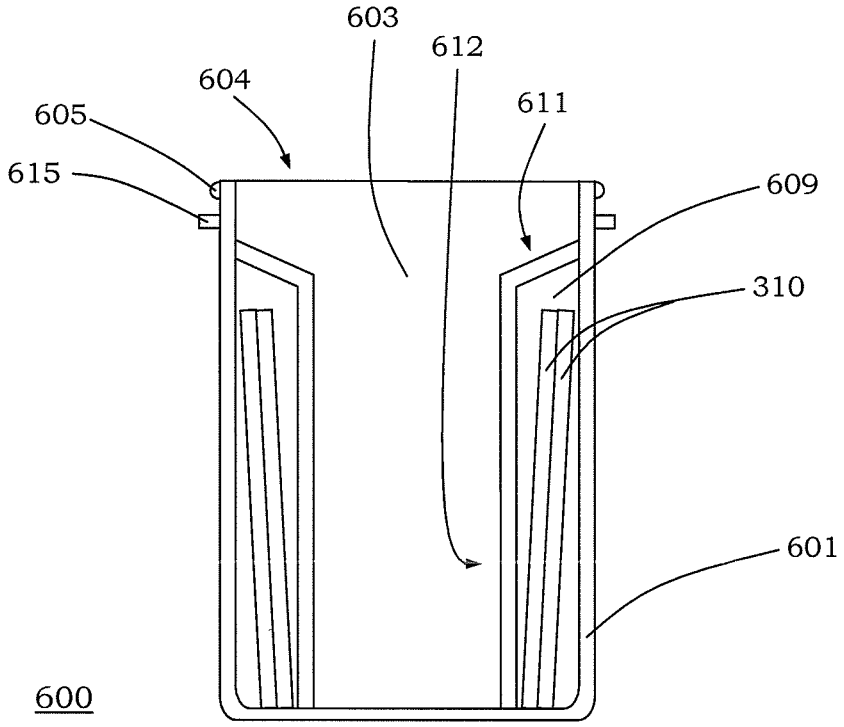
FIG. 6 is a diagram illustrating a second embodiment of the desiccating container according to the present invention.

According to the above-mentioned disclosures, another modified preferable embodiment of the desiccating container is further provided. Please refer to FIG. 6, which is a diagram illustrating a second embodiment of the desiccating container according to the present invention. The desiccating container 600 includes a body 601 and a plurality of vacancies 609 utilized as the space for depositing the desiccant 310 are disposed on the body 601. The desiccating container 600 has the inner space 603 preferably utilized for reserving a glucose strip, a reagent or a drug.

The body 601 preferably has a hollow cylinder shape with an opening 604 at the top of the cylinder. The body 601 further has a blocking ring 615 and an annular ring 605 disposed along a wall near the opening 604. The blocking ring 615 is disposed along an edge of the opening 604 to act as a barrier ring. The blocking ring 615 and the annular ring 605 are preferably made by an electric discharge machine (EDM) scheme or manufactured by a CNC lathe. The body 601 further has a cap (not shown in the FIG. 6) for closing the body 601. While the cap is closed to the opening 604 of the body 601, the sealing boundary of the cap is capable to be tightly resisted to the annular ring 605 for providing an air-sealed function.

It is noted that all the vacancies 609 are preferably disposed symmetrically around the side wall of the body 601. Each of the vacancies 609 further have an opening 611 (invisible in FIG. 6) at one end through which the desiccant 310 is deposited into the containing space 609 and have an aperture 612 (invisible in FIG. 6) with preferably an elongated shape, through which moisture in the inner space 603 of the body 601 is communicable to the desiccant 310 in the vacancies 609, so that the desiccant 310 deposited in all the vacancies 609 could absorb the moisture existing in the inner space 603. The desiccant 310 deposited in the vacancies 609 is preferably selected from a desiccant which has a capability to indicate an effect of moisture absorption thereof or a desiccant which has great capability to absorb moisture, so as to achieve a rapid drying function.

That is, the present invention modifies the shape of the annular ring 305 and 605 to being a circular shape, so as to improve the defects existing in the conventional barrier ring and barrier points. The several advantages for the modified annular ring 305 and 605 are enumerated as follows.

1. A better machining precision: while the annular ring 305 is machined by an EDM scheme or a CNC lathe, the total machined error is minor. Therefore, while the pressure in the atmosphere is reduced, the force distribution along the contact between the annular ring 305 and the cap 306 is almost the same.

2. A much uniform force distribution: the annular ring 305 is contacted with the cap 306 in line, where the force distribution along the contact between the annular ring 305 and the cap 306 is much uniform.

In addition, the desiccating container 300 provided by the present invention has at least several advantages as follows.

1. Good capability to resist a lower external air pressure. For instance, during an air-delivering process, the container 300 is transferred from an ordinary environment to a circumstance with an air pressure lower than the pressure existing in the ordinary environment or in the container 300. Since there is a very small gap existing between the cap 306 and the annular ring 305 of the container 300, the air sealed in the container 300 with higher air pressure is able to gradually leak out through the tiny gap for releasing the higher pressure in the desiccating container 300, which prevents the cap 306 from protruding or busting and avoids the burst of the cap 306.

2. Good drying speed: since a desiccant 310 having strong capability to absorb moisture could be utilized, the speed to dry the inner space 303 containing moisture of the desiccating container 300 is certainly fast.

3. Long-duration drying period: while a desiccant 310 having much thickness is adopted, it means that the moisture-absorbing effect could last longer which is capable to provide a long-duration drying period.

4. Capable to indicate the degree of the humidity in the desiccating container 300: while a desiccant 310 having an indicative surface for indicating the degree of the humidity by color is adopted, a user can easily observe the indicative surface via the elongated aperture 312 to read the color shown thereon for rapidly judging the humidity in the desiccating container 300.

Based on the above descriptions, while the invention has been described in terms of what are presently considered to be the most practical and preferred embodiments, it is to be understood that the invention should not be limited to the disclosed embodiment. On the contrary, it is intended to cap numerous modifications and variations included within the spirit and scope of the appended claims which are to be accorded with the broadest interpretation so as to encompass all such modifications and variations. Therefore, the above description and illustration should not be taken as limiting the scope of the present invention which is defined by the appended claims.

What is claimed is:

1. A desiccating container, comprising:

an outer can having a hollow interior and a bottom; and an inner can, configured within the hollow interior of the outer can and having a bottom disposed proximate the outer can bottom, an inner space therein, an article being stored in the inner space, a side wall peripherally disposed around the inner space and a containing space formed within the side wall, wherein the containing space is used for containing a desiccant, and the containing space has a containing space opening in proximity to the inner can bottom and through which the desiccant is placed into the containing space, and the side wall of the inner can has an aperture through which the containing space and the inner space communicate with each other.

2. The desiccating container according to claim 1 further comprising a cover disposed on the outer can and closing the outer can.

3. The desiccating container according to claim 2, wherein the cover further has an edge and a protrusion protruded from the edge.

4. The desiccating container according to claim 3, wherein the cover further has a sealing boundary disposed around the edge, in which boundary a wall of the outer can is embeddable.

5. The desiccating container according to claim 1, wherein the outer can is a hollow cylinder with an outer can opening at one end thereof.

6. The desiccating container according to claim 5, wherein the outer can further has an annular ring disposed along the outer can opening.

7. The desiccating container according to claim 1, wherein the inner can further has a buckle in proximity to the inner can bottom for fixing the inner can to a position relative to the outer can.

8. The desiccating container according to claim 1, wherein a height of the inner can is smaller than that of the outer can.

9. The desiccating container according to claim 1, wherein a diameter of the inner can is smaller than that of the outer can.

10. The desiccating container according to claim 1, wherein the desiccant has a capability to indicate an effect of moisture absorption thereof.

11. The desiccating container according to claim 1, wherein containing space is formed within a portion of the side wall that is solid except for the aperture.

12. A moisture-absorbing container, comprising:

a body having a hollow interior and a bottom; and an insert fixed within the hollow interior of the body and having a bottom disposed proximate the body bottom, an inner space therein for containing an article, a side wall peripherally disposed around the inner space and a chamber formed within the side wall for containing a desiccant, wherein the inner space and the chamber are communicable with each other through an aperture in the side wall, and the chamber has a chamber opening in proximity to the insert bottom and through which the desiccant is placed into the chamber.

13. The desiccating container according to claim 12, wherein the body further has a cap for closing the body.

14. A moisture absorbing container, comprising:

an outer bottle having a hollow interior and a bottom; and an inner bottle, assembled within the hollow interior of the outer bottle having a bottom disposed proximate the outer bottle bottom, an inner space therein for storing an article, a side wall peripherally disposed around the inner space and a vacancy formed within the side wall for containing a desiccant indicating an effect of moisture absorption thereof, wherein the inner space and the vacancy are communicable with each other through an aperture in the side wall, and the vacancy has a vacancy opening in proximity to the inner bottle bottom and through which the desiccant is placed into the vacancy.

* * * * *